United States Patent [19]

Reinhardt et al.

[11] 3,979,178

[45] Sept. 7, 1976

[54] FINISHING OF CELLULOSE FABRICS WITH N-METHYLOL AMIDE CROSSLINKING AGENTS, MAGNESIUM SULFATE AND SULFURIC ACID

[75] Inventors: Robert M. Reinhardt, New Orleans; Russell M. H. Kullman, Metairie, both of La.

[73] Assignee: The United States of America as represented by the Secretary of Agriculture, Washington, D.C.

[22] Filed: Oct. 9, 1974

[21] Appl. No.: 513,361

[52] U.S. Cl. ..... 8/185; 8/186; 427/392

[51] Int. Cl.[2] ..... D06M 13/40

[58] Field of Search ..... 8/185, 186; 427/392

[56] References Cited

UNITED STATES PATENTS

| | | | |
|---|---|---|---|
| 1,951,994 | 3/1934 | Rochet | 264/184 |
| 3,006,784 | 10/1961 | Ryan | 427/392 |
| 3,009,832 | 11/1961 | Burkett | 427/392 |

*Primary Examiner*—Donald Levy
*Attorney, Agent, or Firm*—M. Howard Silverstein; Salvador J. Cangemi; David G. McConnell

[57] ABSTRACT

Improvement in the strength of fabric finished for durable press properties with an N-methylol amide crosslinking agent and sulfuric acid catalyst is obtained by inclusion of magnesium sulfate in the finishing formulation.

4 Claims, No Drawings

FINISHING OF CELLULOSE FABRICS WITH N-METHYLOL AMIDE CROSSLINKING AGENTS, MAGNESIUM SULFATE AND SULFURIC ACID

FIELD TO WHICH INVENTION RELATES

This invention relates to an improved process for obtaining finished fabrics which have higher strength than normally encountered in fabrics treated for durable press properties with an N-methylol amide crosslinking agent and sulfuric acid. Specifically, this invention relates to the addition of magnesium sulfate to formulations containing an N-methylol amide agent and sulfuric acid so that fabrics treated with said formulations for durable press properties will benefit by having higher strength than fabrics similarly treated in the absence of magnesium sulfate.

THE PRIOR ART

Recently developed processes for producing durable press fabrics have utilized lower than conventional curing temperatures in conjunction with strong catalysis. In the treatment of cellulose-containing fabrics, mineral acids have been shown to be particularly effective in promoting reaction of N-methylol amide agents and the cellulosic component. The mild cure finishing process, reported in the *Textile Chemist and Colorist*, Vol. 1, pages 415–422, Sept. 24, 1969 and Textile Chemist and Colorist, Vol. 2, pages 337–340, Sept. 23, 1970, utilizes such treatment which consists of impregnating fabric with an aqueous solution containing the N-methylol amide crosslinking agent and strong acid catalyst, heating the wet, impregnated fabric, without predrying, at temperatures of 60°–100° C., so that the moisture content at the end of the heating period is about 2–5%, followed by neutralizing, washing and then drying the finished fabric. Mineral acids that are particularly suitable for use in the mild cure finishing process are hydrochloric acid, nitric acid, and sulfuric acid. However, with these acids as catalysts, severe strength losses are sustained by the finished fabric in the absence of fairly precise control of treatment conditions. Salt additives, in particular magnesium chloride and sodium nitrate, were not useful in the mild cure finishing process as they reduced durable press appearance of the finished fabrics.

To circumvent problems encountered in finishing by the mild cure process with strong mineral acids, other suitable catalysts were sought. Inorganic complexes, combinations of acids and salts, strong Lewis acid salts, and other similarly strong catalyst substitutes were required to replace the cheaper, more abundant mineral acids.

THE PROBLEM

The strong acid catalysts used in mild cure finishing are particularly attractive on the basis of the low energy input required to effect the curing reaction between the crosslinking agent and cellulose, but fabric strength loss can be a serious disadvantage. Use of substitute catalyst systems invariably resulted in the need for increased energy inputs above that required in the use of mineral acid catalysis. Highly active catalyst systems employable in finishing treatments as disclosed in U.S. Pat. No. 3,441,367 require a predrying operation before curing and are not suitable in the mild cure process.

Wet fixation treatments as taught in U.S. Pat. No. 3,374,107 employ an acidic component with a salt. However, the wet fixation process requires prolonged treatment times and the maintenance of higher moisture levels in the cotton fiber than operative in mild cure finishing.

No satisfactory catalyst system for treatment by the mild cure process has been found that can give a finished fabric with improved strength at high levels of durable press appearance as compared with that achieved by strong mineral acid alone as catalyst.

OBJECT OF THE INVENTION

It is an object of this invention to provide an improved process through use of a catalyst system incorporating a mineral acid for mild cure finishing of cellulose-containing textiles that results in increased strength in the finished fabrics without loss of durable press performance. The importance of an improved fabric strength without adverse effect on durable press appearance is readily apparent to those skilled in the art.

HOW THE OBJECT IS ACHIEVED

We have found that inclusion of magnesium sulfate in formulations containing sulfuric acid and a methylol amide crosslinking agent to treat cellulosic materials by the mild cure finishing process provides a treated fabric with greater strength than when the magnesium sulfate is omitted. The strength improvement is particularly surprising as treatments with the strong mineral acids, nitric or hydrochloric acid, as catalysts with their corresponding magnesium salts included in the formulations do not exhibit this same effect.

The process of the instant invention may thus be described as that in which a fabric is impregnated with a formulation containing an N-methylol amide crosslinking agent, sulfuric acid, and magnesium sulfate followed by heat treatment at relatively low temperatures to cure the wet, impregnated fabric. We have found that fabric strength, as compared to that of treatments in the absence of magnesium sulfate, improves with increasing concentration of the salt.

Textiles which can be treated by this improved process include cellulose-containing materials which may be woven, knitted, or nonwoven. Derivation of the cellulose fiber component, whether regenerated or natural, in no way affects the process of this invention nor does diminution of the amount of cellulosic component of the textile by the presence of fibers of other types limit the process.

N-Methylol amide agents operative in the formulations of this improved process are formaldehyde adducts of alkyl carbamates, alkoxyalkyl carbamates, hydroxyalkyl carbamates and the like. Cyclic ureas, particularly with reactive hydroxy groups attached to the imidazolidinone ring structure, may be employed which include 4,5-dihydroxyimidazolidinone. Formaldehyde adducts of imidazolidinone ring structures also are suitable in the process of this invention. Among these, dimethylol dihydroxyethyleneurea is particularly useful. N-Acetoxymethyl and N-alkoxymethyl derivatives of the imidazolidinones and derivatives with other similar leaving groups may be used. The amount of N-methylol amide crosslinking agent used in the improved process of the present invention for treatment of the cellulose-containing material may vary from about 5 to about 20%, by weight, based upon the weight of the treatment bath. About 9 to 15% of the N-methylol amide, or the equivalent of N-alkoxymethyl or N-acetoxymethyl amide, is preferred.

The amount of magnesium sulfate effective in this improved process is from about 0.3 to about 2.5%, by weight, based upon the weight of the treatment bath. A preferred range is from about 0.6% to about 1.8%, by weight, of the treatment formulation.

Sulfuric acid may be used in concentrations of from about 0.2 to about 2%, by weight, of the treatment formulation. The preferred range is from about 0.5 to about 1.5% of sulfuric acid, by weight, of the treatment formulation.

Temperatures effective in curing the wet, impregnated textile are from about 60° C. to 110° C. for from about 2 minutes to about 8 minutes. The preferred temperature range is from about 60° C. to about 100° C. to obtain a moisture content in the finished fabric of about 2–5%.

SUMMARY OF THE INVENTION

In summary, the use of magnesium sulfate in formulations with an N-methylol amide crosslinking agent and sulfuric acid for the treatment of cellulose-containing textile materials by the mild cure finishing process has advantages over the use of these formulations without said salt. Use of magnesium sulfate results in higher strength retention in the finished fabric, with no adverse effect on durable press appearance, than is achieved by treatments employing only the N-methylol amide agent and sulfuric acid.

In the following examples, all formulations are aqueous solutions. They contain only the cited ingredients, the remainder of the formulations being water. However, this does not preclude the inclusion of compatible additives or agents in the formulations to enhance other properties that may be desired in the finished textile. The examples are provided for illustrative purposes and are not intended to limit the scope and spirit of the invention as will be understood by those skilled in the art.

EXAMPLE 1

Samples of cotton printcloth were impregnated to wet pickups of about 90% with aqueous solutions, 100 g. of which contained 15 g. of dimethylol dihydroxyethyleneurea and:

- Sample 1A: 10 millimoles of hydrochloric acid (0.365 g. HCl);
- Sample 1B: 10 millimoles of hydrochloric acid (0.365 g. HCl) and 10 millimoles of magnesium chloride (2.03 g. $MgCl_2.6H_2O$);
- Sample 2A: 10 millimoles of nitric acid (0.63 g. $HNO_3$);
- Sample 2B: 10 millimoles of nitric acid (0.63 g. $HNO_3$) and 10 millimoles of magnesium nitrate (2.56 g. $Mg(NO_3)_2.6H_2O$);
- Sample 3A: 10 millimoles of sulfuric acid (0.98 g. $H_2SO_4$);
- Sample 3B: 10 millimoles of sulfuric acid (0.98 g. $H_2SO_4$) and 10 millimoles of magnesium sulfate (1.20 g. $MgSO_4$).

The wet, impregnated fabrics were pinned on frames and treated by the mild cure finishing process by heating in a forced air-circulation oven at 100° C. for 2.5 minutes which reduced the moisture content of the treated fabrics to about 2–5%. The treated samples were analyzed and tested after washing. Durable press ratings of the samples were determined after laundering and drying by the Procedure of the American Association of Textile Chemists and Colorists, AATCC Test Method 124–1969 (AATCC Technical Manual, Volume 46, pages 177–178, 1970); breaking strengths were determined on 1-inch strips by ASTM Method D1682-64; and nitrogen contents by the Kjeldahl Method. Strengths of the B samples are reported as percent of their respective "A" samples. Results are shown in Table I:

TABLE I

| Sample | Durable press rating after tumble drying | Durable press rating after line drying | %N | % Strength ($\frac{B}{A} \times 100$) |
|---|---|---|---|---|
| 1A | 4.0 | 4.5 | 1.69 | — |
| 1B | 4.2 | 3.6 | 1.65 | 98.7 |
| 2A | 4.0 | 4.0 | 1.64 | — |
| 2B | 3.6 | 4.0 | 1.67 | 100.1 |
| 3A | 4.3 | 4.3 | 1.64 | — |
| 3B | 4.0 | 4.3 | 1.62 | 135.2 |

The use of magnesium chloride in conjunction with hydrochloric acid as catalyst did not result in finished fabric with strength improved over that of fabric treated with the acid alone as catalyst (compare Samples 1A and 1B). Similarly the use of magnesium nitrate with nitric acid produced no improvement (Samples 2A and 2B). Quite unexpectedly, however, addition of magnesium sulfate to sulfuric acid resulted in significant strength improvement as seen in comparison of Samples 3A and 3B.

Example 2

Samples of cotton printcloth were impregnated to wet pickups of about 90% with aqueous solutions, 100 g. of which contained 15 g. of dimethylol dihydroxyethyleneurea and:

- Sample 1C: 10 millimoles of hydrochloric acid (0.365 g. HCl) and 5 millimoles of magnesium chloride (1.02 g. $MgCl_2.6H_2O$);
- Sample 1D: 10 millimoles of hydrochloric acid (0.365 g. HCl) and 15 millimoles of magnesium chloride (3.05 g. $MgCl_2.6H_2O$);
- Sample 2C: 10 millimoles of nitric acid (0.63 g. $HNO_3$) and 5 millimoles of magnesium nitrate (1.28 g. $Mg(NO_3)_2.6H_2O$);
- Sample 2D: 10 millimoles of nitric acid (0.63 g. $HNO_3$) and 15 millimoles of magnesium nitrate (3.84 g. $Mg(NO_3)_2.6H_2O$);
- Sample 3C: 10 millimoles of sulfuric acid (0.98 g. $H_2SO_4$) and 5 millimoles of magnesium sulfate (0.60 g. $MgSO_4$);
- Sample 3D: 10 millimoles of sulfuric acid (0.98 g. $H_2SO_4$) and 15 millimoles of magnesium sulfate (1.80 g. $MgSO_4$).

The wet, impregnated fabrics were cured by the procedure of Example 1 and evaluated.

Strengths of B,C, and D samples were compared to their respective A samples of Examples 1 and 2 and are plotted in the following figure as percent.

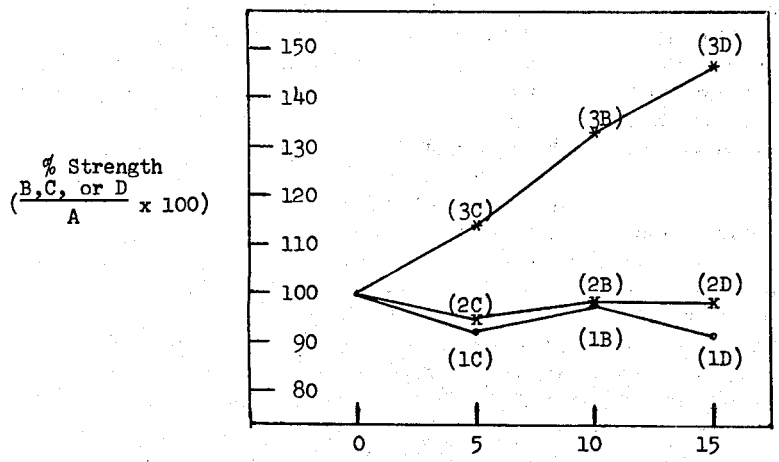

Millimoles of magnesium salt per 100 grams of aqueous solution containing 10 millimoles of acid and 15 grams of dimethylol dihydroxyethyleneurea.

The striking improvement in fabric strength produced by use of magnesium sulfate in conjunction with sulfuric acid as catalyst is demonstrated in this plot and is contrasted with the effect produced by the other magnesium salts with their respective inorganic acids. These results with magnesium sulfate are achieved, furthermore, with no decrease in the amount of dimethylol dihydroxyethyleneurea bound, as measured by nitrogen content, nor in detriment to durable press performance of the treated fabric. Tumble- and line dry DP ratings for Samples 3A to 3D all were in the range of 4.0 to 4.3 and nitrogen values ranged from 1.68 to 1.6 %.

EXAMPLE 3

Samples of cotton printcloth were impregnated to wet pickups of about 90% with aqueous solutions, 100 g. of which contained 15 g. of dimethylol dihydroxyethyleneurea and:

Sample 4A: 5 millimoles of sulfuric acid (0.49 g. $H_2SO_4$);

Sample 4B: 5 millimoles of sulfuric acid (0.49 g. $H_2SO_4$) and 5 millimoles of magnesium sulfate (0.60 g. $MgSO_4$);

Sample 5A: 15 millimoles of sulfuric acid (1.47 g. $H_2SO_4$);

Sample 5B: 15 millimoles of sulfuric acid (1.47 g. $H_2SO_4$) and 15 millimoles of magnesium sulfate (1.80 g. $MgSO_4$).

The wet, impregnated fabrics were cured by the procedure of Example 1 and evaluated. Results are shown in Table II.

TABLE II

| Sample | Durable press rating after tumble drying | Durable press rating after line drying | % N | % Strength ($\frac{B}{A} \times 100$) |
|---|---|---|---|---|
| 4A | 4.3 | 4.5 | 1.61 | — |
| 4B | 4.0 | 4.2 | 1.56 | 128 |
| 5A | 4.3 | 4.3 | 1.61 | — |
| 5B | 4.2 | 4.2 | 1.68 | 130 |

The above results show that the beneficial effects of magnesium sulfate on fabric strength are operative over a wide concentration range.

EXAMPLE 4

Samples of cotton printcloth were impregnated to wet pickups of about 95% with aqueous solutions, 100 g. of which contained 15 g. of dimethylol methyl carbamate and:

Sample 6A: 10 millimoles hydrochloric acid (0.365 g. HCl);

Sample 6B: 10 millimoles hydrochloric acid (0.365 g. HCl) and 10 millimoles of magnesium chloride (2.03 g. $MgCl_2.6H_2O$);

Samples 7A and 8A: 10 millimoles of sulfuric acid (0.98 g. $H_2SO_4$);

Samples 7B and 8B: 10 millimoles of sulfuric acid (0.98 g. $H_2SO_4$) and 10 millimoles of magnesium sulfate (1.20 g. $MgSO_4$).

The wet, impregnated Samples 6A, 6B, 7A, and 7B were cured following the procedure of Example 1 and evaluated.

The wet, impregnated Samples 8A and 8B were cured by the procedure of Example 1 except that heating was at 60° C. for 8 minutes. Samples were evaluated and results are given in Table III.

TABLE III

| Sample | Durable press rating after tumble drying | Durable press rating after line drying | % N | % Strength ($\frac{B}{A} \times 100$) |
|---|---|---|---|---|
| 6A | 3.7 | 4.4 | 1.10 | — |
| 6B | 3.7 | 3.9 | 1.04 | 100 |
| 7A | 3.5 | 4.5 | 1.15 | — |
| 7B | 3.9 | 4.4 | 1.11 | 118 |
| 8A | 3.3 | 4.5 | 1.17 | — |
| BB | 3.3 | 3.9 | 0.99 | 120 |

The above results demonstrate the effectiveness of the improved process on fabric strength with carbamate finishing agents. These results also demonstrate the lower limits of curing temperature.

We claim:

1. In a process of finishing cellulose-containing fabrics to impart durable press properties by treatment with aqueous formulations containing N-methylol amide crosslinking agents, crosslinking catalysts, and, other compatible additives or agents to enhance properties other than durable press or strengh properties, the improvement consisting of:

a. adding to aqueous formulations as the sole crosslinking catalyst, a mixture of sulfuric acid and magnesium sulfate in amounts such that for every 100 parts by weight of said formulation there are about from 5 to 20 parts by weight N-methylol amide crosslinking agent, about from 0.2 to 2 parts by weight of sulfuric acid, and about from 0.3 to 2.5 parts by weight of magnesium sulfate;

b. impregnating a cellulose-containing textile with the formulation from a; and Serial No. 513,361 c. curing the wet, impregnated textile by heat treatment at from about 60°C to about 100°C for about from 2 minutes to about 8 minutes to obtain a moisture content in the treated textile of about 2 to 5%; and d. washing and drying the textile.

2. In a process of finishing cellulose-containing fabrics to impart durable press properties by treatment with aqueous formulations containing an N-methylol amide crosslinking agent selected from the group consisting of dimethylol dihydroxyethyleneurea and dimethylol methyl carbamate, crosslinking catalysts, and, other compatible additives or agents to enhance properties other than durable press or strength properties, the improvement consisting of:

a. adding to aqueous formulations as the sole crosslinking catalyst a mixture of sulfuric acid and magnesium sulfate in amounts such that for every 100 parts by weight of said formulation there are about from 9 to 15 parts by weight of the N-methylol amide crosslinking agent, about from 0.5 to 1.5 parts by weight sulfuric acid, and about from 0.6 to 1.8 parts by weight of magnesium sulfate;

b. impregnating the cellulose-containing textile with said formulation;

c. curing the wet, impregnated textile by heat treatment at from about 60°C to about 100°C for about from 2 minutes to about 8 minutes to obtain a moisture content in the treated textile of about 2 to 5%; and d. washing and drying the textile.

3. The process of claim 2 wherein the N-methylol amide crosslinking agent is dimethylol dihydroxyethyleneurea.

4. The process of claim 2 wherein the N-methylol amide crosslinking agent is dimethylol methyl carbamate.

* * * * *